US006615555B2

(12) United States Patent
Madden

(10) Patent No.: US 6,615,555 B2
(45) Date of Patent: Sep. 9, 2003

(54) LIGHT TRANSMITTING STORM SHUTTER SYSTEM

(76) Inventor: Michael Madden, 1889 NW. 22nd St., Pompano Beach, FL (US) 33069

( * ) Notice: Subject to any disclaimer, the term of this patent is extended or adjusted under 35 U.S.C. 154(b) by 0 days.

(21) Appl. No.: 09/885,306

(22) Filed: Jun. 20, 2001

(65) Prior Publication Data

US 2002/0023388 A1 Feb. 28, 2002

Related U.S. Application Data

(60) Provisional application No. 60/215,147, filed on Jun. 30, 2000.

(51) Int. Cl.[7] ..... E06B 3/26
(52) U.S. Cl. ..... 52/202; 52/537; 428/182
(58) Field of Search ..... 52/202, 537; 428/182

(56) References Cited

U.S. PATENT DOCUMENTS

| | | | | | |
|---|---|---|---|---|---|
| 1,195,505 | A | | 8/1916 | Saino | |
| 1,204,074 | A | | 11/1916 | Saino | |
| 1,240,634 | A | | 9/1917 | Williams | |
| 2,878,536 | A | | 3/1959 | Becker | |
| 3,358,408 | A | | 12/1967 | Cooper | |
| 4,283,451 | A | * | 8/1981 | Abrahami | 428/182 |
| 4,333,271 | A | | 6/1982 | DePaolo et al. | |
| 4,685,261 | A | | 8/1987 | Seaquist | |
| 4,695,033 | A | * | 9/1987 | Imaeda et al. | 249/189 |
| 5,345,716 | A | * | 9/1994 | Caplan | 52/202 |
| 5,457,921 | A | * | 10/1995 | Kostrzecha | 52/202 |
| 5,579,615 | A | * | 12/1996 | Hoffman | 52/202 |
| 5,595,233 | A | | 1/1997 | Gower | |
| 5,651,221 | A | * | 7/1997 | Golen | 52/202 |
| 5,852,903 | A | | 12/1998 | Astrizky | |
| 5,911,660 | A | | 6/1999 | Watson | |
| 5,918,430 | A | | 7/1999 | Rowland | |
| 5,996,292 | A | | 12/1999 | Hill et al. | |
| D421,807 | S | | 3/2000 | Reid | |
| 6,079,168 | A | * | 6/2000 | Shaver | 52/202 |
| 6,546,681 | B1 | * | 4/2003 | Trundle | 52/202 |

* cited by examiner

*Primary Examiner*—Carl D. Friedman
*Assistant Examiner*—Nahid Amiri
(74) *Attorney, Agent, or Firm*—Mark D. Bowen, Esq.; Stearns Weaver Miller Weissler Alhadeff & Sitterson, P.A.

(57) ABSTRACT

A light transmitting storm shutter system for homes, buildings and the like includes a combination of full width corrugated aluminum and half width clear polycarbonate panels arranged in alternating adjacent and partially overlapping relation over a given window or door opening. The aluminum panels provide structural integrity while the polycarbonate panels provide light transmittance. The combination of full width aluminum panels and half width polycarbonate panels provides a storm shutter system that is substantially stronger and more resistant to impact deflection than the light transmitting storm shutters disclosed in the background art, and eliminates the need for additional hardware, supports, and bracing.

5 Claims, 6 Drawing Sheets

LIGHT TRANSMITTING STORM SHUTTER SYSTEM

CROSS REFERENCE TO RELATED APPLICATIONS

This application claims the benefit of provisional U.S. Patent Application Ser. No. 60/215,147, filed Jun. 30, 2000.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights.

BACKGROUND OF THE INVENTION

1. Field of the Invention

This invention relates generally to storm shutters for protecting homes, buildings and other structures from wind and storm related damage, and more particularly to a light transmitting storm shutter assembly that provides sufficient resistance to hurricane force winds and impact from wind-borne debris while allowing light transmittance into the protected structure.

2. Description of the Background Art

The United States has experienced 44 weather-related disasters in the past 20 years, each of which has caused in excess of $1 billion in damages. Of these 44 disasters, 38 occurred between 1988 and 1998 causing in excess of $170 billion in damage.

Population growth along the coastline of the United States has resulted in an increased risk to life and property from hurricane related damage. There are approximately 36 million permanent residents along the hurricane-prone coastline of the United States, with areas such as Texas, Florida, and the Carolinas, where hurricanes frequently strike, experiencing rapid population growth. In addition, many coastal areas experience substantial but temporary population increases from holiday, weekend, and vacation visitors during hurricane season.

Homes, buildings and other structures, suffer substantial damage when storm generated winds, and particularly wind-borne debris, penetrate the structures through window and door openings. Hurricane shutters have long been used as barriers to protect window and door openings from the effects of storm generated winds. Equipping homes and other buildings with hurricane protection in the form of storm shutters is one of the most prudent actions one can take to protect life and property.

Accordingly, the background art reveals a number of storm shutters designed for removable installation on homes and buildings. Conventional storm shutters typically consist of corrugated metal panels affixed to the outside of a given structure. For example, U.S. Pat. No. 2,878,536, issued to Becker, discloses a shutter structure having overlapping corrugated panels. U.S. Pat. No. 4,333,271, issued to DePaolo et al., discloses a hurricane panel system for covering windows and doors. The '271 patent discloses a plurality of corrugated metal panels arranged in overlapping relationship to provide a protective structure. U.S. Pat. No. 5,345,716, issued to Caplan, discloses a storm shutter system comprising a combination of individual, interlocking modular elements. U.S. Pat. No. 5,852,903, issued to Astrizky, discloses a hurricane shutter comprising a pair of normally open doors that are swingable to a closed position. U.S. Pat. No. 5,911,660, issued to Watson, discloses a storm panel comprising a plurality of interlocking tiles interlocked together by a plurality of dovetail joints.

A significant disadvantage with conventional storm shutter panels is that installation of the panels over all of the window openings prevents light from entering the structure. Accordingly, if power is lost, as often happens during severe storms, the occupants of the structure find themselves in total darkness. Thus, a number of references disclosed in the background art reveal attempts to provide storm shutters that provide sufficient impact resistance while allowing light to enter to building.

For example, U.S. Pat. No. 5,918,430, issued to Rowland, discloses a removable storm shield comprising convex panels. U.S. Pat. No. 5,996,292, issued to Hill et al., discloses a perforated shutter system wherein at least one panel is formed of corrugations. U.S. Pat. No. 3,358,408, issued to Cooper et al., discloses an insulated light transmitting panel construction having corrugations in the side edges thereof. U.S. Pat. No. 4,685,261, issued to Seaquist, discloses a removable translucent storm shutter consisting of a ½" thick polycarbonate sheet in an aluminum channel frame. U.S. Pat. No. 5,595,233, issued to Gower, discloses hurricane shutters formed of transparent, double-skinned panels that are strengthened by rods extending through the end channels. The panels are mounted side-by-side to cover the expanse of a window or door being protected. U.S. Pat. No. 5,457,921, issued to Kostrzecha, discloses a storm shutter in the form of a "kit". The kit includes a plurality of corrugated shatter-resistant and transparent plastic sheets fastened to the structure using a mounting mechanism and fasteners inserted through keyway slots.

While the use of clear plastic panels, such as Polycarbonate panels, provides light transmittance, the use of plastics can substantially reduce structural integrity and impact resistance as plastics are generally not as strong as the metal alloys, such as aluminum or steel, typically used to fabricate storm panels as disclosed in the background art. Accordingly, the clear polycarbonate storm panel structures of the background art must be fabricated to a greater thickness and/or require additional bracing and hardware that complicates installation and increases cost. For example, the '921 patent discloses corrugated polycarbonate storm panels that use stiffening cross bar members. Furthermore, the '233 patent discloses panels that are strengthened by rods extending through channels. Since weather reporting agencies typically allow a mere 24 hours in which to install storm protection installation time is an important factor.

Accordingly, there exists a need for a light transmitting storm panel assembly that avoids the disadvantages present in the storm panels disclosed in the background art.

BRIEF SUMMARY OF THE INVENTION

The present invention provides a light transmitting storm shutter system for homes, buildings and the like that overcomes the disadvantages present in the background art. A storm panel system according to the present invention includes a combination of corrugated aluminum and clear polycarbonate panels arranged in alternating adjacent relation over a given window or door opening. The aluminum panels provide structural integrity while the polycarbonate panels allow light to pass through the storm shutter system.

More specifically, the storm panel system comprises a combination of full width corrugated aluminum panels with half width corrugated polycarbonate panels installed therebetween in partially overlapping relation. The combination of full width aluminum panels and half width polycarbonate panels provides a storm shutter system that is substantially stronger and more resistant to impact deflection than the light transmitting storm shutters disclosed in the background art, and eliminates the need for additional hardware, supports, bracing etc.

Accordingly, it is an object of the present invention to provide an improved storm shutter assembly for protecting building openings from windborne debris.

Still another object of the present invention is to provide a light transmitting storm panel that has substantial impact resistance.

Yet another object of the present invention is to provide a light transmitting storm panel assembly for protecting building openings from windborne debris in compliance with the latest and strictest building codes.

Still another object of the present invention is to provide a light transmitting storm shutter assembly that achieves a high level of impact resistance without requiring the use of additional stiffeners or cumbersome cross-bracing.

Yet another object of the present invention is to provide a light transmitting panel system capable of being used in an awning or overhang configuration.

In accordance with these and other objects that will become apparent hereinafter, the instant invention will now be described with particular reference to the accompanying drawings.

DETAILED DESCRIPTION OF THE INVENTION

Figures 1, 1A:
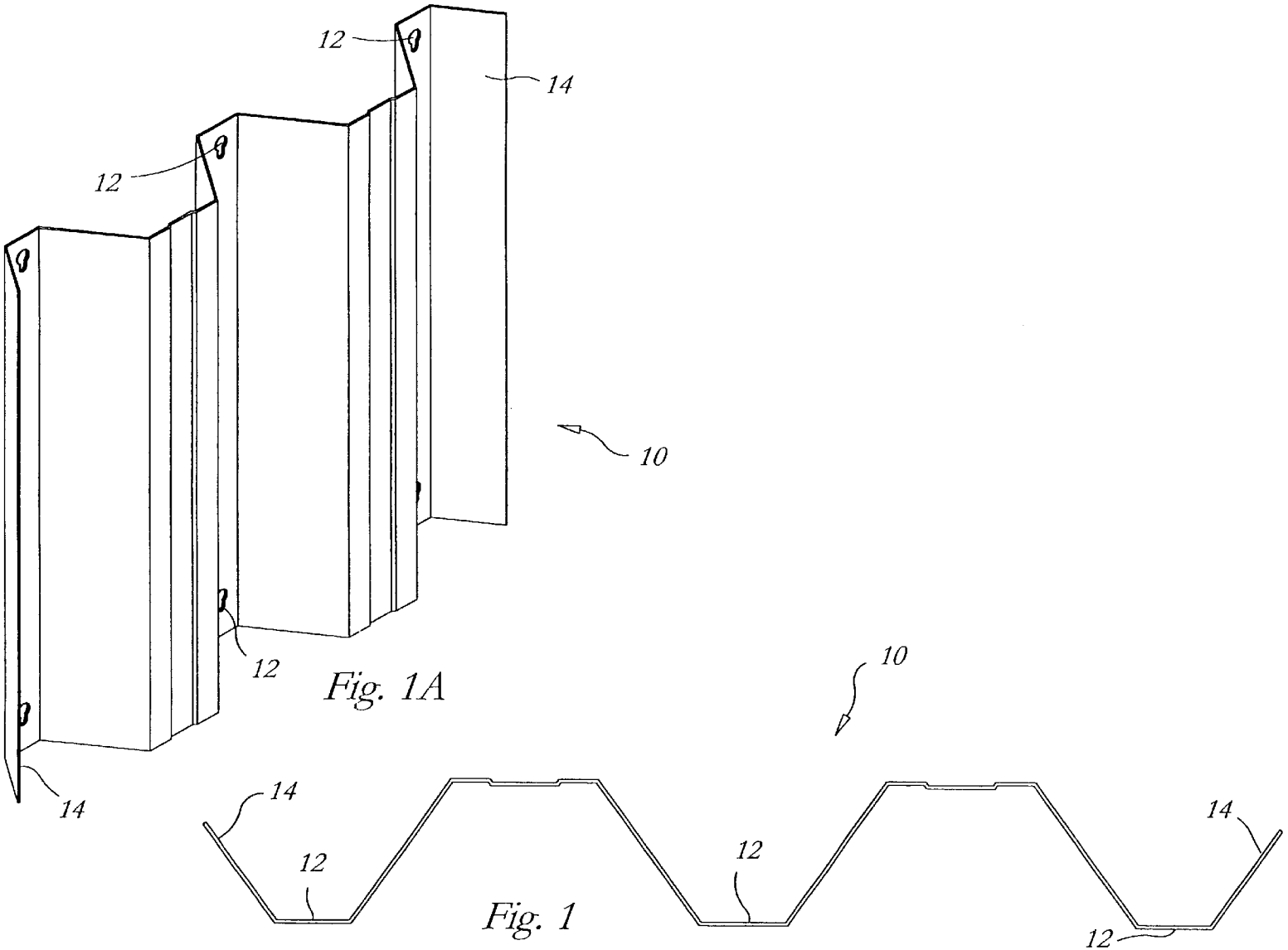
FIG. 1 is a cross-sectional view of a corrugated full-width metal panel according to the present invention.
FIG. 1A is a perspective view thereof.

With reference now to the drawings, the present invention provides an improved light transmitting storm shutter assembly comprising an alternating series of individual metal (e.g. aluminum or steel) and polycarbonate panels installed in partially overlapping relation. FIGS. 1 and 1A depict a preferred embodiment of a corrugated metal panel, referenced as 10, according to the present invention. Metal panel 10 preferably comprises a corrugated aluminum panel having a nominal thickness of approximately 0.040" to 0.063" (or 18 gauge to 24 gauge if fabricated from steel), and includes corrugated portions resulting in an overall depth of approximately 2.0". Each panel defines a plurality of apertures 12, spaced 6.0" apart and aligned along the width of the panel, for receiving suitable fasteners as more fully disclosed hereinbelow. Metal panel 10 further includes obliquely projecting wing portions 14 formed on opposing sides thereof. The metal panel depicted in FIG. 1 may have an overall width of approximately 15.125" which width provides a nominal 12.0" of coverage. For purposes of description herein panel 10 may be referred to as a "full-panel". Furthermore, the term metal encompasses various metallic materials such as aluminum, and/or suitable gauge steel, or titanium.

Figure 2A:
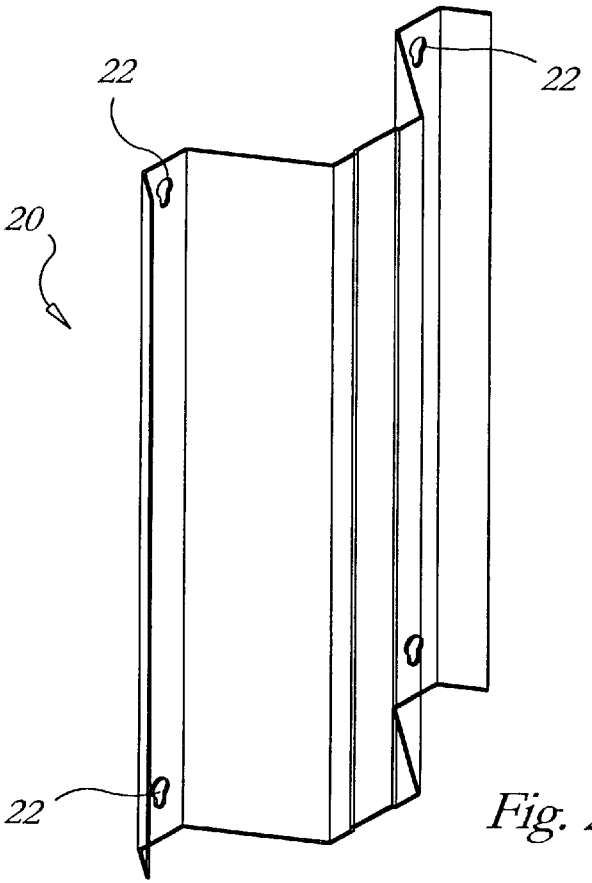
FIG. 2A is a perspective view thereof.
Figure 2:
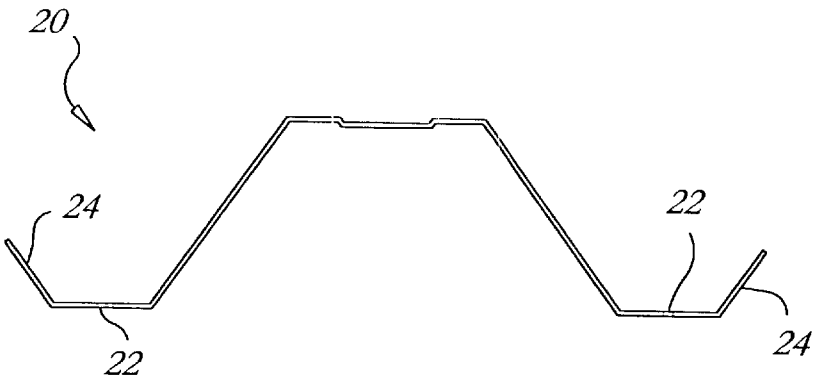
FIG. 2 is a cross-sectional view of a corrugated half-width clear polycarbonate panel according to the present invention.

FIGS. 2 and 2A depict a preferred embodiment of a corrugated half width panel, referenced as 20, according to the present invention. Panel 20 preferably comprises a corrugated polycarbonate panel having a nominal thickness of approximately 0.075", and includes corrugated portions resulting in an overall depth of approximately 2.0". Each polycarbonate panel 20 defines a plurality of apertures 22, spaced 6.0" apart, as seen in FIG. 2, and suitably spaced and aligned along the length of the panel, for receiving suitable fasteners as more fully disclosed hereinbelow. Polycarbonate panel 20 further includes angularly projecting wing portions 24 on opposing ends thereof. As depicted in FIG. 2, panel 20 has an overall width of approximately 8.0" and provides a nominal 6.0" of coverage. For purposes of description herein panel 10 may be referred to as a "half-panel", e.g. a panel width that is approximately one-half the width of a full panel.

Figure 3:
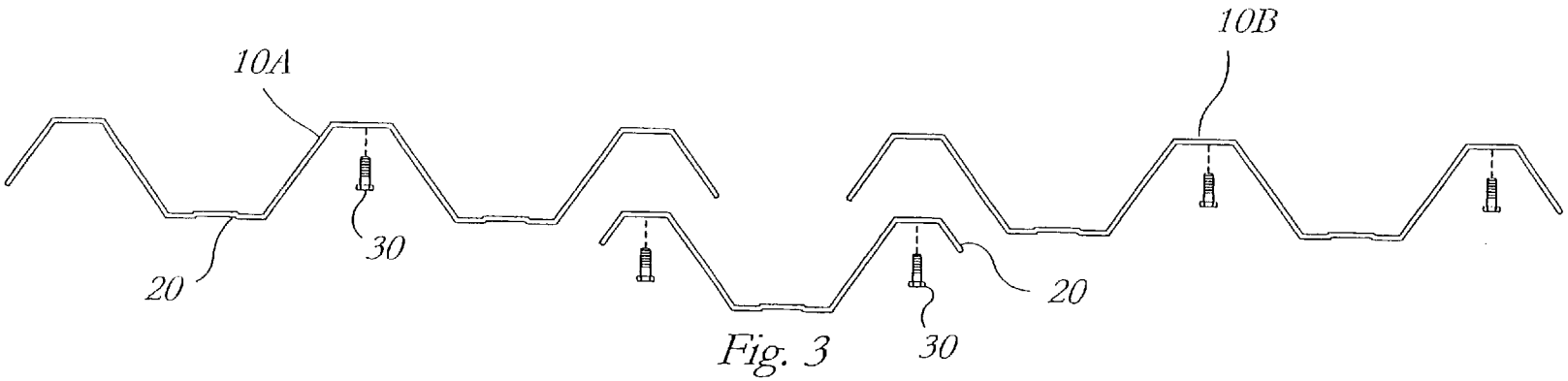
FIG. 3 is an exploded end view showing the panels in relative position for installation.
Figure 4:
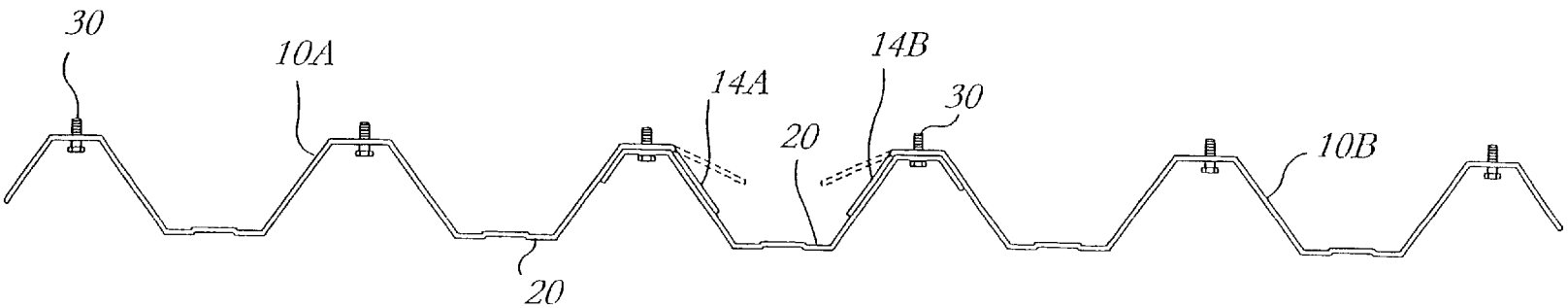
FIG. 4 is an assembled end view thereof.

FIGS. 3 and 4 illustrate the relative positions of metal panels 10 and polycarbonate panels 20 to form a storm shutter assembly with panels arranged in adjacent, partially overlapping relation to cover an opening. The panel assembly is preferably secured to the structure by fasteners 30. As best seen in FIG. 3, a nominal 30" opening may be covered by installation of two full-width metal panels, referenced as 10A and 10B, and one half-width polycarbonate panel 20 in adjacent partially overlapping relation. It is important that the polycarbonate panel(s) be positioned on the outer facing side of the metal panels (e.g. metal panels disposed between polycarbonate panels and structure) as the present invention specifically relies on this configuration for providing an assembly that has the greatest strength and impact resistance. More particularly, impact resistance is maximized in the disclosed configuration as the polycarbonate panel(s) 20 is supported from the structure side (e.g. back) by the metal panels 10, and particularly by the projecting wing portions 14 of each adjacent metal panel. In a preferred embodiment, wing portions 14 are approximately 1.75" in length. It has been found that wing portions of shorter lengths do not provide sufficient support for the overlapping polycarbonate panel thereby degrading impact resistance of the assembly. The structure disclosed herein has been subjected to impact testing wherein it was unexpectedly found that objects impacting the polycarbonate panel sections result in a certain amount of deflection in the metal panels, and particularly deflection of the wing portions, such that the wing portions each temporarily deflect to a position that is more parallel (e.g. less angled) relative to the wall of the structure. The geometry is such that the deflection causes the wing portions 14 to extend toward the center of the polycarbonate panel 20 during the deflection, thereby directly supporting a larger portion of the polycarbonate panel from the rear. The gap existing between the metal panels 10A and 10B, is thus narrowed by deflection of wings 14A and 14B. Impact testing confirms that deflection of metal wings 14 provides additional structural support to the inherently weaker polycarbonate panels thereby increasing impact resistance. Conversely, if the wing portions 14 were eliminated or if the polycarbonate panels were positioned on the opposite side of the metal panels impact resistance would be significantly decreased.

Figure 5:
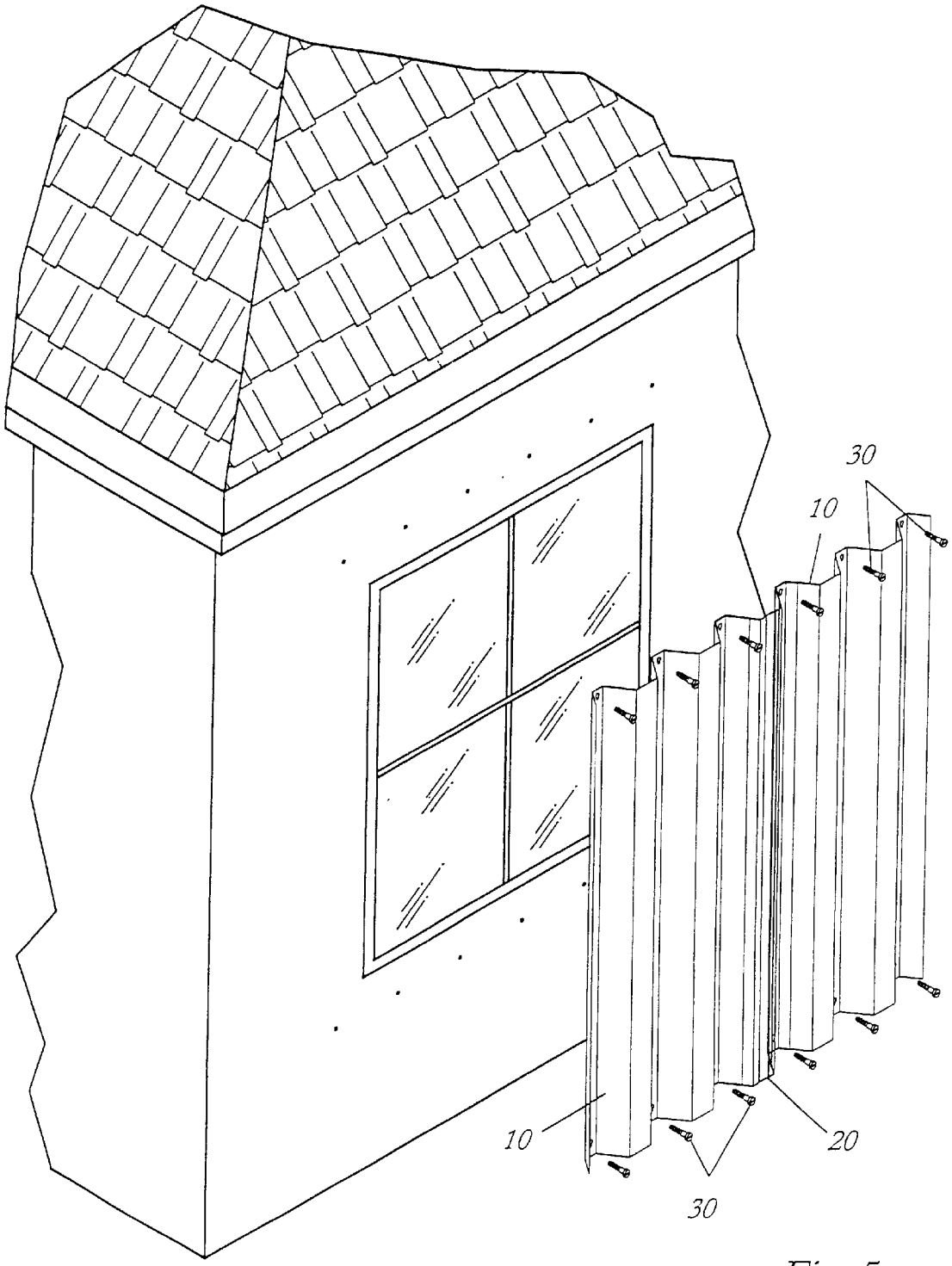
FIG. 5 is an exploded perspective view of the panels prior to installation over a window opening.
Figure 6:
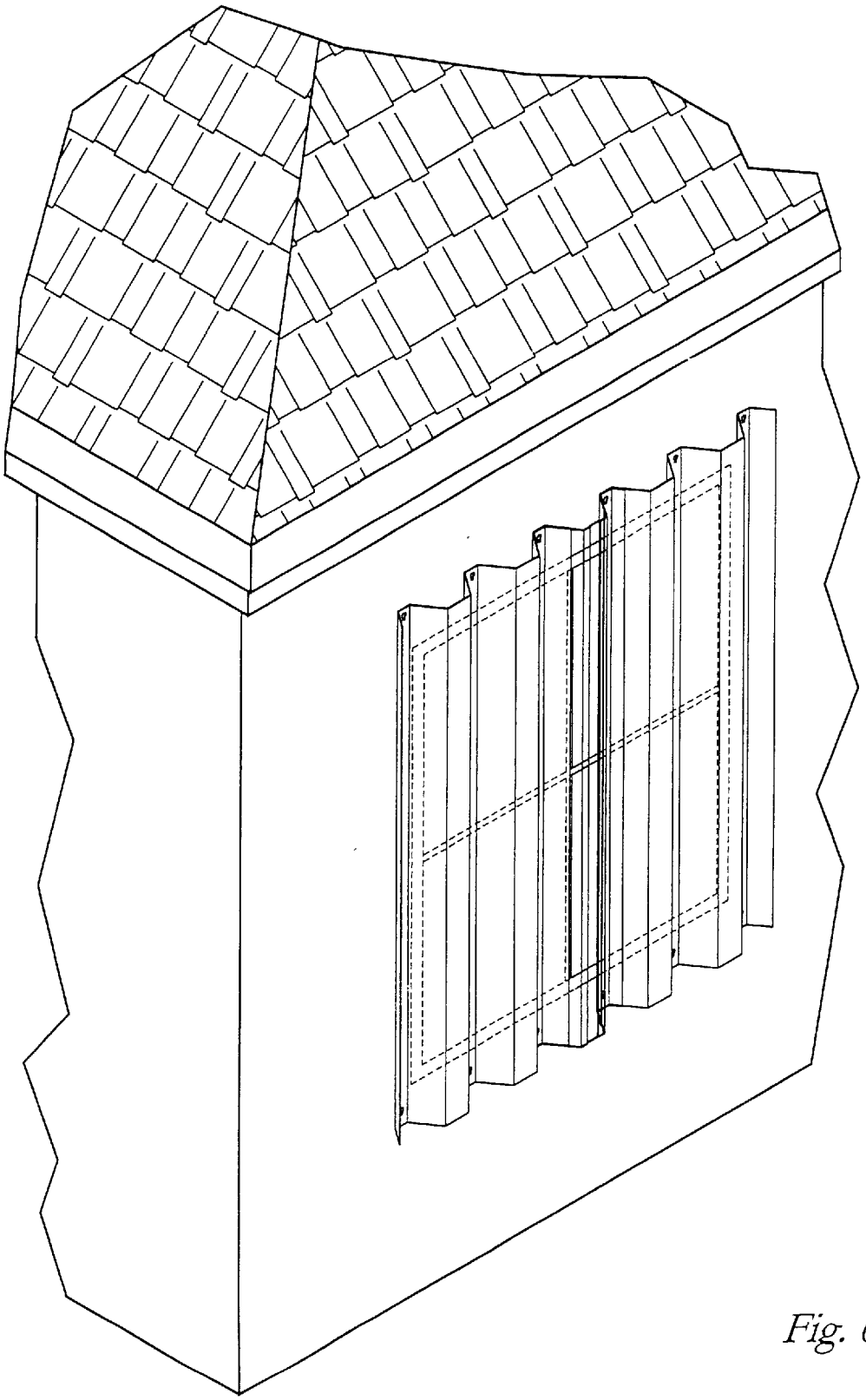
FIG. 6 is a perspective view of the panels installed over a window opening.
Figure 7:
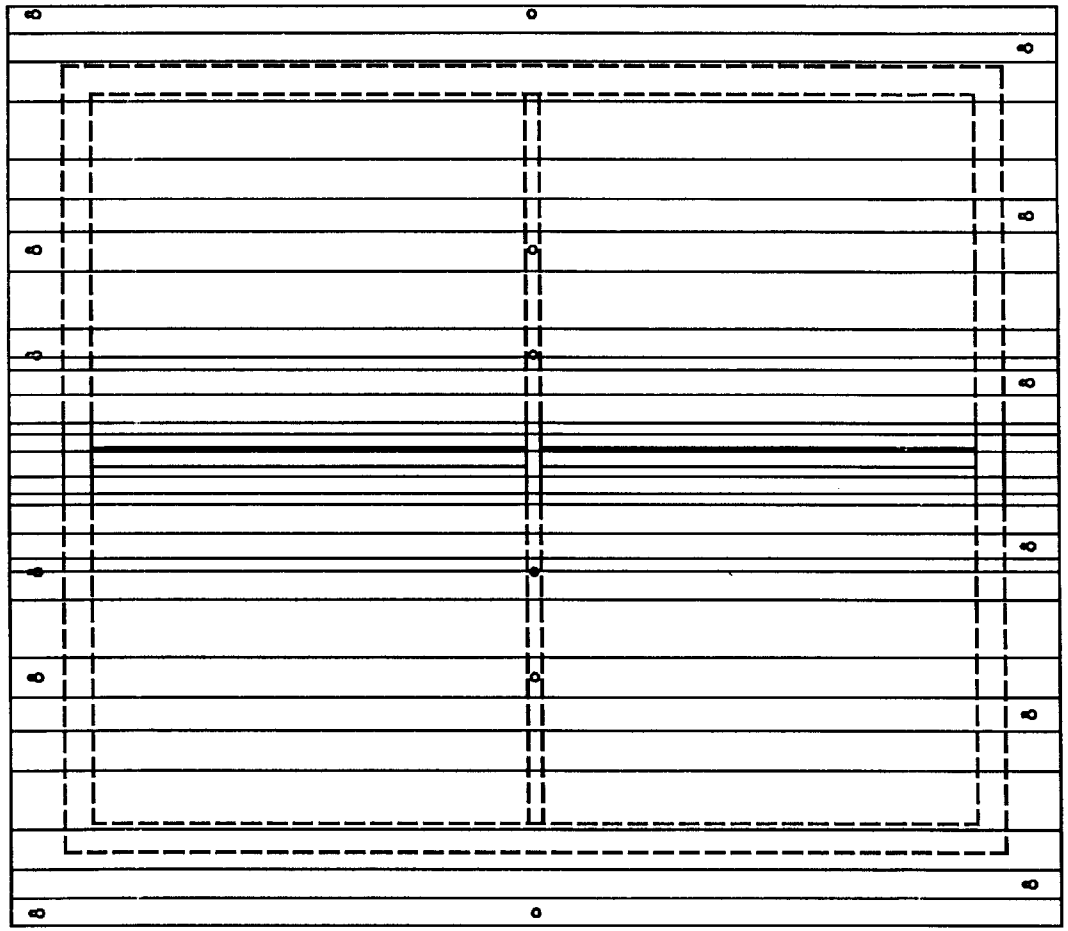

Panels 10 and 20 may be mounted using additional mounting hardware, such as an aluminum header, or other suitable hardware, such as known track devices (e.g. "F" Tracks, "C" Tracks, "E" Tracks and the like), anchored to the structure surrounding the opening to be covered. As best seen in FIGS. 3–6, fasteners 30 are preferably used to anchor the panels to the structure and/or to fasten the panels in overlapping configuration. As best depicted in FIGS. 5 and 6, a light transmitting, impact resistant storm shutter assembly is formed by anchoring a sufficient number of metal panels 10 and clear polycarbonate panels 20 to cover an opening of any given width. FIG. 6 depicts a storm shutter assembly according to the present invention installed on a building in covering relation with a window opening.

As should be apparent, the use of light transmitting (e.g. transparent and/or translucent) plastic half panels allows available ambient light to pass through the installed storm shutter assembly into the protected structure thereby avoiding a significant disadvantage present with conventional all Aluminum and/or Steel storm shutters. Furthermore, the use of half width polycarbonate panels disposed between full width Aluminum and/or Steel panels provides a barrier that is sufficiently resistant to impact so as to comply with even the most stringent codes. In addition, the assembly disclosed herein allows for the use of thinner/less expensive polycarbonate panels thereby providing a light transmitting storm shutter assembly that offers impact resistance at a lower cost than an all polycarbonate assembly.

The storm shutter assembly disclosed herein has been tested in accordance with the 1999 Standard Building Code, SSTD 12–99, a test standard for determining impact resistance from windborne debris. The panels disclosed herein are also suitable for use in connection with roof openings (e.g. skylights). In addition, the panels may be configured for use as an awning. Finally, since polycarbonate is more costly than aluminum or steel, the alternating Aluminum and polycarbonate panel configuration provides a light transmitting storm shutter that is far less costly than the all polycarbonate storm shutters disclosed in the background art.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What I claim is:

1. A storm shutter assembly for mounting on an exterior portion of a building to protect window or door openings from high winds, flying debris and rain, said storm shutter assembly comprising:

at least two corrugated metal panels, each of said metal panels having opposing obliquely projecting lateral wing portions, said metal panels each defining a width dimension;

at least one corrugated transparent plastic panel having a plurality of generally planar sections including a face section, left and right obliquely projecting lateral sections extending from said face section, said left and right obliquely projecting lateral sections each terminating in a mounting section disposed in generally parallel relation with said face section, said plastic panel having a width dimension of approximately one-half the width dimension of said metal panels;

means for securely mounting said at least two metal panels and said at least one plastic panel to a building structure over a window or door opening in a mounted configuration wherein each plastic panel is disposed between two laterally adjacent metal panels in a partially overlapping configuration, and wherein said metal panels are sandwiched between said at least one plastic panel and the exterior of the building such that said wing portions are disposed in supporting contact with said plastic panel.

2. A storm shutter assembly for mounting on an exterior portion of a building structure according to claim 1, wherein said obliquely projecting lateral wing portions each have a length of at least 1.5 inches.

3. A storm shutter assembly for mounting on an exterior portion of a building structure according to claim 1, wherein said transparent panels are polycarbonate.

4. A shutter assembly for mounting on an exterior portion of a building structure according to claim 1, wherein said means for securely mounting said panels to a building includes threaded fasteners received through apertures in said panels and affixed to said building.

5. A storm shutter assembly for mounting on an exterior portion of a building structure to protect window or door openings from high winds, flying debris and rain, said storm shutter assembly comprising:

a plurality of corrugated metal panels, each of said metal panels having a width dimension, each of said metal panels terminating in opposing obliquely projecting lateral wings, each of said wings having a length of at least 1.5";

at least one corrugated transparent plastic panel having a width dimension of approximately one-half the width dimension of said metal panels, each of said at least one corrugated transparent plastic panel having a plurality of generally planar sections including a face section, left and right obliquely projecting lateral sections extending from said face section, said left and right obliquely projecting lateral sections each terminating in a mounting section disposed in generally parallel relation with said face section;

means for securely mounting said at least two metal panels and said at least one plastic panel to a building structure over a window or door opening in a mounted configuration wherein back plastic panel is disposed between laterally opposing metal panels in a partially overlapping configuration, and wherein said metal panels are sandwiched between said at least one plastic panel and the exterior of the building such that said metal panel wings provide reinforcement for each of said plastic panels.

* * * * *